United States Patent [19]

Huang et al.

[11] Patent Number: 4,988,225

[45] Date of Patent: Jan. 29, 1991

[54] CONTINUOUS SELF-INKING RIBBON CARTRIDGE SYSTEM

[75] Inventors: George C. Huang, Bethany, Conn.; Daniel Zhu, Rego Park, N.Y.

[73] Assignee: Jing Tech, Inc., Bethany, Conn.

[21] Appl. No.: 243,243

[22] Filed: Sep. 8, 1988

Related U.S. Application Data

[63] Continuation-in-part of Ser. No. 185,844, Apr. 25, 1988, abandoned.

[51] Int. Cl.[5] ..... B41J 32/02

[52] U.S. Cl. ..... 400/196.1; 400/202.2; 400/208

[58] Field of Search ..... 400/194, 196.1, 197, 400/200, 202.2, 217.1, 234, 224.2, 208; 118/256, 260; 16/75; 267/166

[56] References Cited

U.S. PATENT DOCUMENTS

| | | | |
|---|---|---|---|
| 2,969,865 | 5/1960 | Long | 400/200 |
| 4,616,942 | 10/1986 | Nagasawa et al. | 400/196.1 |
| 4,639,153 | 1/1987 | Cheng | 400/202.1 |
| 4,741,639 | 5/1988 | Fausto et al. | 400/196.1 |
| 4,747,711 | 5/1988 | Motta et al. | 400/196.1 |

FOREIGN PATENT DOCUMENTS

| | | | |
|---|---|---|---|
| 2033872 | 5/1980 | Italy | 400/202.4 |

*Primary Examiner*—Edgar S. Burr
*Assistant Examiner*—Ren Yan
*Attorney, Agent, or Firm*—McCormick, Paulding & Huber

[57] ABSTRACT

A novel leakproof ribbon cartridge system includes an ink reservoir and wick which, together, are configured to form a closed system such that ink is constantly recirculated between the reservoir and the wick. In addition, the ribbon cartridge includes a spring apparatus for providing a print ribbon to the wick only when the ribbon cartridge is in operation.

16 Claims, 5 Drawing Sheets

CONTINUOUS SELF-INKING RIBBON CARTRIDGE SYSTEM

This is a Continuation-In-Part of the commonly owned copending application Ser. No. 185,844, filed on Apr. 25, 1988, now abandoned.

TECHNICAL FIELD

This invention relates to printing ribbon cartridges and more particularly to printing ribbon cartridges characterized by a continuous, self-inking ribbon cartridge system.

BACKGROUND OF THE INVENTION

Printing ribbon spools or cartridges which include a means for replenishing the ink drawn from a printing ribbon are well known in the art. Most typically, these reinking devices comprise an inking roller impregnated with ink which is pressed against a ribbon. Other ribbon spools have a liquid ink reservoir with a wick placed in contact with a ribbon.

Those spools or cartridges characterized by a roller mechanism include the reinking device disclosed in U.S. Pat. No. 4,653,947. Detailed therein is an endless ribbon cartridge used with newer computer printers and typewriters. The '947 947 device includes a rotatable pinch roller mounted on an inker case, a force ink-impregnated inking roller tangent to the pinch roller which is configured with a spring biasing mechanism to maintain a constant relation with the pinch roller. The inker case is pivotably mounted within the cartridge housing and the spring is biased such that the pinch roller mounted to the inker case is urged into frictional contact with the drive roller with the ribbon passing therebetween. Ink is passed to the ribbon as the ribbon is pulled between the pinch and ink rollers.

The '947 reinking cartridge is exemplary of roller type reinking devices of the prior art. All roller type devices are characterized by an ink-impregnated ribbon placed in a cartridge or on a spool. The ink is somewhat replenished as it is drawn past the ink roller. Most importantly, that portion of the ribbon in contact with the roller will become soaked with excessive ink because the ribbon is in continuous contact with the ink-impregnated roller all of the time, even when the printer is not in use. Consequently, characters printed for a time after the printer has restarted will be non-uniform (excessively dark), lowering the print quality of the document.

While forced ink roller-type cartridges are configured to avoid leakage, each possesses the following disadvantages. Initially, a provision must be made in the cartridge for the ink-impregnated roller. The ink roller performs no function other than to ink the ribbon, and is therefore a source of extra cost. Secondly, there must be included a spring mechanism and an opposing roller to urge the ink roller against the ribbon. There must also be a provision in the cartridge to interface the reinking ribbon mechanism with the remainder of the cartridge. All of the above lead to increased cost and complexity.

Furthermore, the roller type reinking cartridges have a finite shelf life, since the reinking roller begins to dry as soon as the cartridge leaves the factory. Lastly, there is no control over the amount of ink which is provided to the ribbon. When the inking cartridge is fresh an unnecessary large quantity of ink will be provided to the ribbon and, as the cartridge ages, the ribbon will provide an undesirably small quantity of ink.

It would be advantageous for a ribbon cartridge device to provide a continuous self-inking of the ribbon. This device should not be susceptible to leakage and should be easily adapted for use in a variety of cartridge type printing machines. The present invention is directed towards such a ribbon cartridge.

SUMMARY OF THE INVENTION

An object of the present invention is to provide for a ribbon cartridge system which provides continuous self-inking of a ribbon.

Another object of the present invention is to provide for a ribbon cartridge system which is easily adaptable to existing printing device configurations.

Still another object of the present invention is to provide for a ribbon cartridge system that generates characters of uniform print density.

Another object of the present invention is to provide for a closed ribbon cartridge system having an ink reservoir which recirculates excessive ink, avoiding any ink leakage.

Yet another object of the present invention is to provide for a ribbon cartridge having an ink reservoir which can be used at any angle.

Another object of the present invention is to provide a ribbon cartridge system whose print quality is controlled with an air-ink exchange mechanism that is configured in accordance with the printer speed.

Still another object of the present invention is to provide a ribbon cartridge system which provides ink to the ribbon only when the printer is in use.

Another object of the present invention is to provide for a ribbon cartridge system which is contained in an insert to be configured in a conventional ribbon cartridge case or shell.

According to the present invention, a reservoir element for use with a ribbon cartridge having a case and further having an endless ribbon circulating therein includes a container having liquid ink initially sealed in a first chamber and a means for enabling the ink to flow into a second container chamber. A wick is configured with the second container chamber to controllably present ink at the exterior of the container after the second chamber receives the ink.

According to another aspect of the present invention, a ribbon cartridge system for use with a printing device includes an endless ribbon and a case for receiving the ribbon. The case is adapted to be received by the printing device so as to enable the ribbon to be advanced while the printing device is in use. A plurality of rollers guide the ribbon to and from the case. An ink reservoir element is also included, and comprises a container having liquid ink initially sealed in a first chamber, and includes a means for selectively enabling the ink to flow into a second container chamber. A wick is configured with the second container chamber to controllably present the ink at the exterior of the container. After the seal between the first and second container chamber is broken, the ink migrates to the second chamber and saturates the wick. An apparatus provides that excess ink is recirculated back from the wick, eliminating any possibility of drippage. A ribbon tensioning apparatus is included in the case and is configured to allow the ribbon to communicate with the wick only when the ribbon is advanced by the printing device.

DETAILED DESCRIPTION OF THE PREFERRED EMBODIMENT

Figure 1:
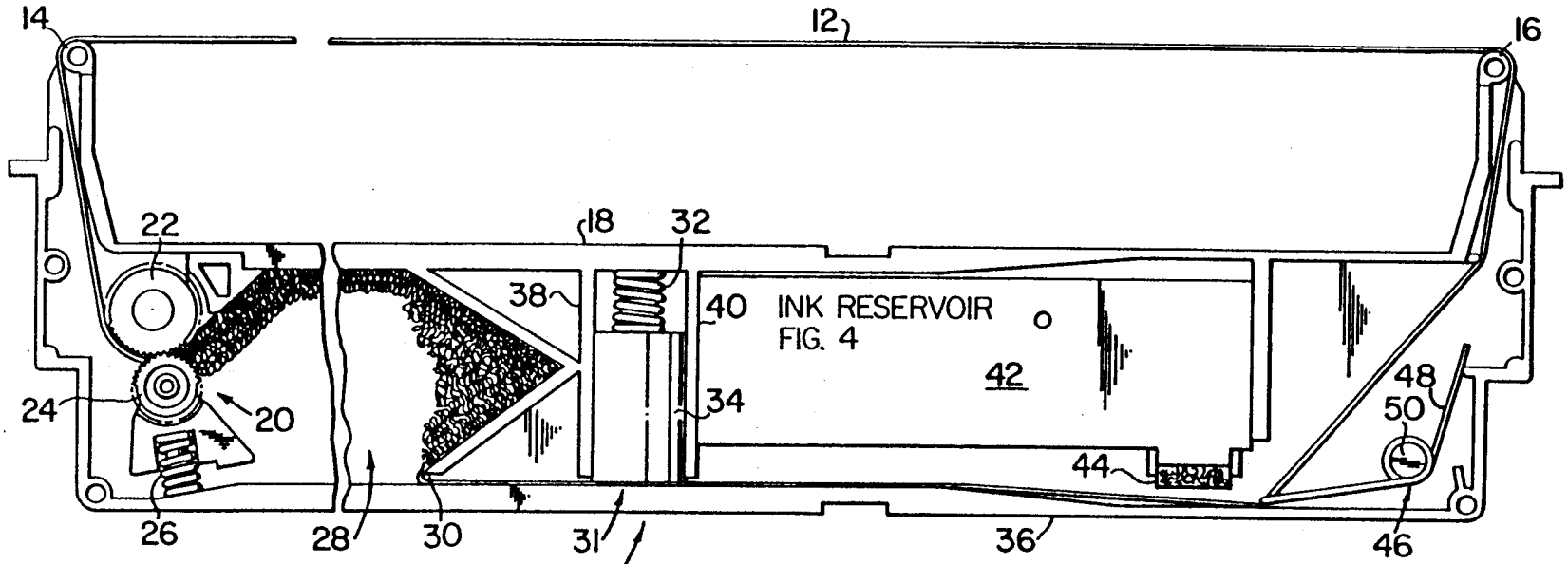
FIG. 1 is a simplified top view of a portion of a ribbon cartridge provided according to the present invention.

Referring now to FIG. 1, there is a top illustration of a ribbon cartridge 10 provided according to the present invention. The ribbon cartridge 10 has a conventional external configuration and is adapted for use with a variety of conventional printers and is therefore interchangeable with a variety of existing ribbon cartridges, such as an Epson RX-100, FX-100, a Burroughs AP1354 or Newcoat BM 153. At present there are many different standard printer configurations, each requiring printing cartridges of standard external configuration. A ribbon cartridge provided according to the present invention is easily adapted in accordance with the intended printer application.

As noted, the ribbon cartridge 10 is exemplary of endless ribbon type cartridges used with computer printers, teleprinters and typewriters. A ribbon 12 extends between roller assemblies or guides 14 and 16 which hold the ribbon in a spaced relation with respect to a body 18. Inside a first portion of the body is a receiving roller assembly 20 comprised of first and second tension rollers 22 and 24. An extended portion of the first roller 22 is received by an advancing mechanism in the printer, not shown and not part of the present invention. In the embodiment of FIG. 1, the roller 22 is rotated in a counterclockwise manner to advance ribbon 12 from left to right. Roller 24 is urged against roller 22 by a spring 26, as is well known in the art. The ribbon is of an endless type and is fed into a cavity 28 in a well known manner.

At a distal end of cavity 28 the ribbon passes through an opening 30 before being presented to a ribbon tensioning mechanism 31. In the embodiment of FIG. 1, the ribbon tensioning mechanism comprises a spring 32 which urges a cylinder 34 against a rear wall 36 of the cartridge body. The ribbon passes therebetween. The spring and cylinder combination is laterally located by retaining walls 38 and 40.

Figure 2:
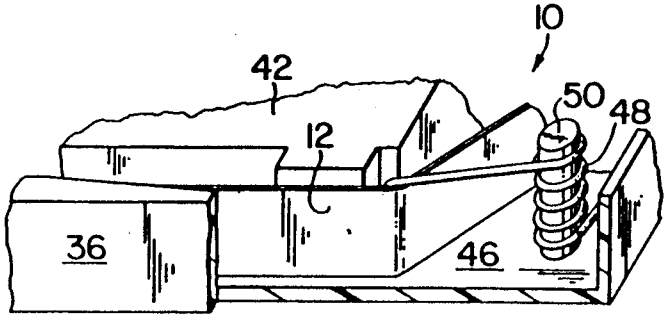
FIG. 2 is a side illustration of a portion of the ribbon cartridge of FIG. 1 detailing a spring mechanism that controls the application of the ribbon to the wick.

As described hereinafter, ink reservoir 42 provides ink in a selectively controlled, continuous fashion through wick 44 only when the printer is in use. Ribbon positioning mechanism 46 is configured to maintain the position of the ribbon against the cartridge back wall when the printer is idle. As shown in FIG. 2, the ribbon positioning mechanism in the preferred embodiment comprises a longitudinally wound coil spring 48 positioned with post 50.

The ribbon tensioning mechanism 31 and the ribbon positioning mechanism 46 together comprise a ribbon control means.

Figure 3:
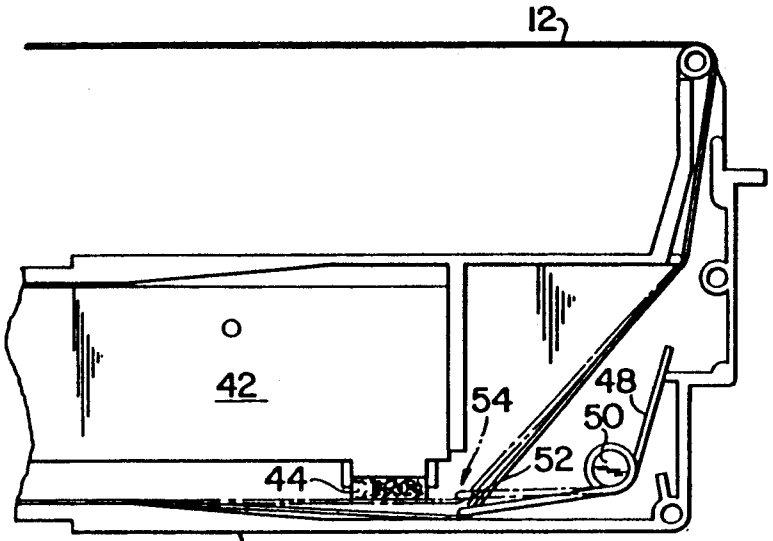
FIG. 3 illustrates a portion of the ribbon cartridge of FIG. 1 illustrating first and second ribbon positions relative to the wick.

Referring now to FIG. 3, there is a top view of a portion of the ribbon cartridge of FIG. 1. In FIG. 3, ribbon 12 is shown in a first position 52 in which spring 48 exerts a force against the ribbon to maintain it approximately against the back wall 36 of the ribbon cartridge. As the ribbon is advanced past cylinder 34 and roller 16, it generates an opposite force that moves the ribbon away from the wall 36 to a second position 54, shown in broken line, communicating with the wick. The magnitude of the force exerted by spring 48 against the ribbon is preferably configured to be less than or equal to that force produced by the rotation of the roller 22, so that when the ribbon is advanced, it simultaneously moves away from the back wall to engage the wick 44. Conversely, when the printer has stopped, the ribbon automatically is withdrawn from the wick. Those skilled in the art will note that the magnitude of the restoring force generated by spring 48 should be selected in accordance with the magnitude of the force exerted by spring 32. Too small a force exerted by spring 32 will produce insufficient tension in the ribbon by the action of cylinder 34 to allow the ribbon to be moved in contact with the wick.

Too large a force will prevent the ribbon from being displaced from the wick at In the preferred embodiment, the ribbon cartridge system is equivalent to an Epson MX-100 and spring 48 is configured to provide a ribbon displacement force of approximately 28–40 grams, while the force exerted by spring 32 is substantially between 13 to 17 grams.

As the ribbon is drawn across the wick, ink from the reservoir is supplied to a portion of the printing surface of the ribbon by means of capillary action. The ink subsequently dissipates locally throughout the printing surface of the ribbon in a uniform, even manner. Continuous application of ink, coupled with its distribution throughout the printing surface of the ribbon ensures that print quality will always be uniform, no matter what portion of the ribbon is printing and irrespective of the age of the cartridge.

The ribbon positioning mechanism 46 which provides for selective engagement of the ribbon with the wick only when the cartridge is in operation marks a point of departure of the present invention over the prior art. Known ribbon printing devices which have employed liquid reservoirs have maintained the ribbon in contact with the ink source. This has resulted in a premature draining of ink in the reservoir, as well as an undesirable super saturation of that portion of the printing ribbon in prolonged contact with the wick. Ink leakage has been the result. In contrast, the present ribbon cartridge provides ink to the ribbon only when the cartridge is actually in use thereby avoiding all leakage.

Figure 4:
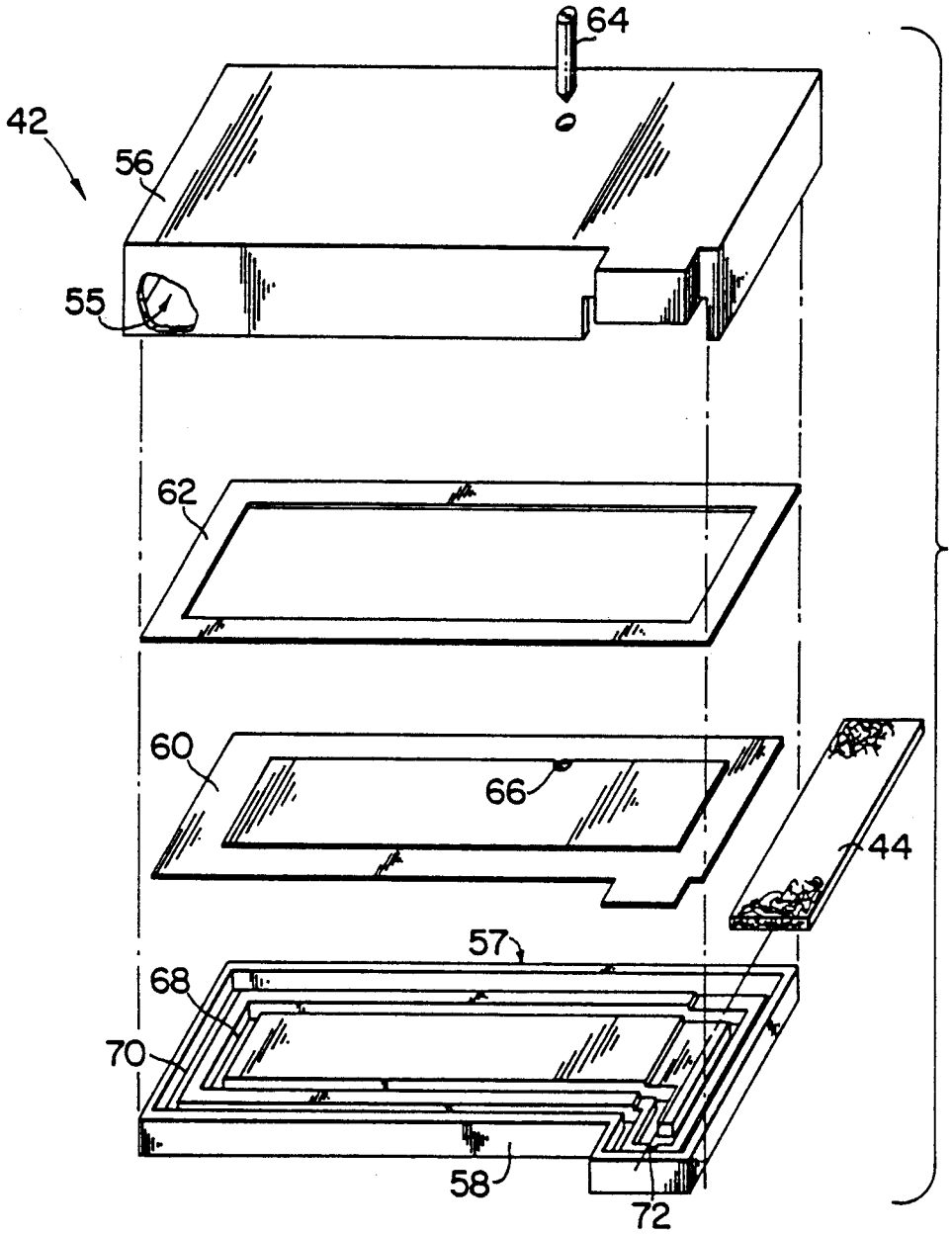
FIG. 4 is an exploded view of an ink reservoir used with the ribbon cartridge of FIG. 1.

Referring now to FIG. 4, there is an exploded illustration of the ink reservoir 42 of FIG. 1. In addition to wick 44, the ink reservoir is characterized by first and second cavities or chambers formed 55, 57 formed respectively in reservoir case portions 56 and 58. The reservoir also includes a seal 60 which is placed therebetween. An additional seal 62 may also be included during fabrication as is required. The ink reservoir is configured so that, when assembled, the reservoir case 42 is inverted from the position illustrated in FIG. 4. Liquid ink is provided to the cavity or chamber in case portion 56 with seals 60 and 62 positioned therewith before case portion 58 and wick 44 are provided. When assembled, the ink reservoir contains only ink in the first cavity formed within the case portion 56, even when inverted. Consequently, the ink cannot evaporate or leak out from the first cavity, resulting in an indefinite shelf life for the present ribbon cartridge system. When the cartridge system is to be placed in service, pin 64, positioned within the case portion 56, is displaced to puncture weakened section 66 in the seal, thereby allowing ink to flow into the lower cavity formed within case portion 58 and ultimately saturating the wick with ink. Although a conventional wick may be used, it is preferable to employ a commercially available spun-bonded polyester fibrous material of 0.027 wick thickness made by DuPont Company under the trademark Relmay TM, part No. 2470.

The lower case portion forms a chamber that is preferably comprised of a sequence of two channels 68 and 70. The channel 68 is interior to the channel 70, and acts as an ink supply channel to the wick. The outer channel 70 is a recirculation channel and extends up from underneath the wick, allowing ink which has propagated to the exterior wick portion to return to the interior. Air is allowed to enter into the ink reservoir interior cavities through air flow means comprising channel 72 configured to connect the interior supply channel with the exterior return channel. The surface area of the air channel controls the rate of ink transfer to the wick. Those skilled in the art will note that the air exchange mechanism can include a plurality of air channels connecting the channels 68 and 70 adjacent to and in conjunction with channel 72.

Figure 5:
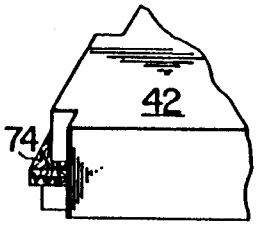
FIG. 5 is a side illustration of the ink reservoir of FIG. 4 shown with a double wick.

Those skilled in the art will also note that the ribbon cartridge system having a reservoir as described hereinabove comprises a closed system that includes an ink reservoir and the wick. The wick is supplied by at least one channel and includes a second return channel such that the ink is constantly flowing from the reservoir through the wick and back to the reservoir again. This marks a point of departure in the present invention over the prior art. In some applications it may be desirable to employ a double layer wick 74, shown in FIG. 5, to provide further protection against drippage.

A ribbon cartridge system provided according to the present invention can be configured for use with standard ink, but it is preferable that a polymer based ink, such as that made by Image Specialist of Hauppauge, N.Y., be employed. That ink has the following characteristics:

| | | |
|---|---|---|
| Pigment | 0–5% | |
| Viscosity | 100–500 | centipoise |
| Dye | 10–30% | |
| Fatty acid | 5–15% | |
| Mineral Oil | 0–10% | |
| Vegetable Oil | 5–20% | |
| Glycol ether ester | 0–25% | |
| Fatty amide | 0–3% | |
| Fatty aliphatic naphtha | 0–5% | |

This polymer based ink can be configured with 1200 CPS to 200 CPS having a surface tension index between 40 to 45; as opposed to standard abrasive ink which has a surface tension index of 30 to 35.

Those skilled in the art will also note that the viscosity of the ink can be adjusted to allow for operation of the printer in other than a horizontal position. In the preferred embodiment, the ribbon cartridge 10 can be operated at angles up to 45° without any leakage of the ink from the reservoir. Those skilled in the art will note that appropriate adjustments to the viscosity of the ink can be made to operate the printer at angles up to and including vertical without any leakage of ink.

Figure 6:
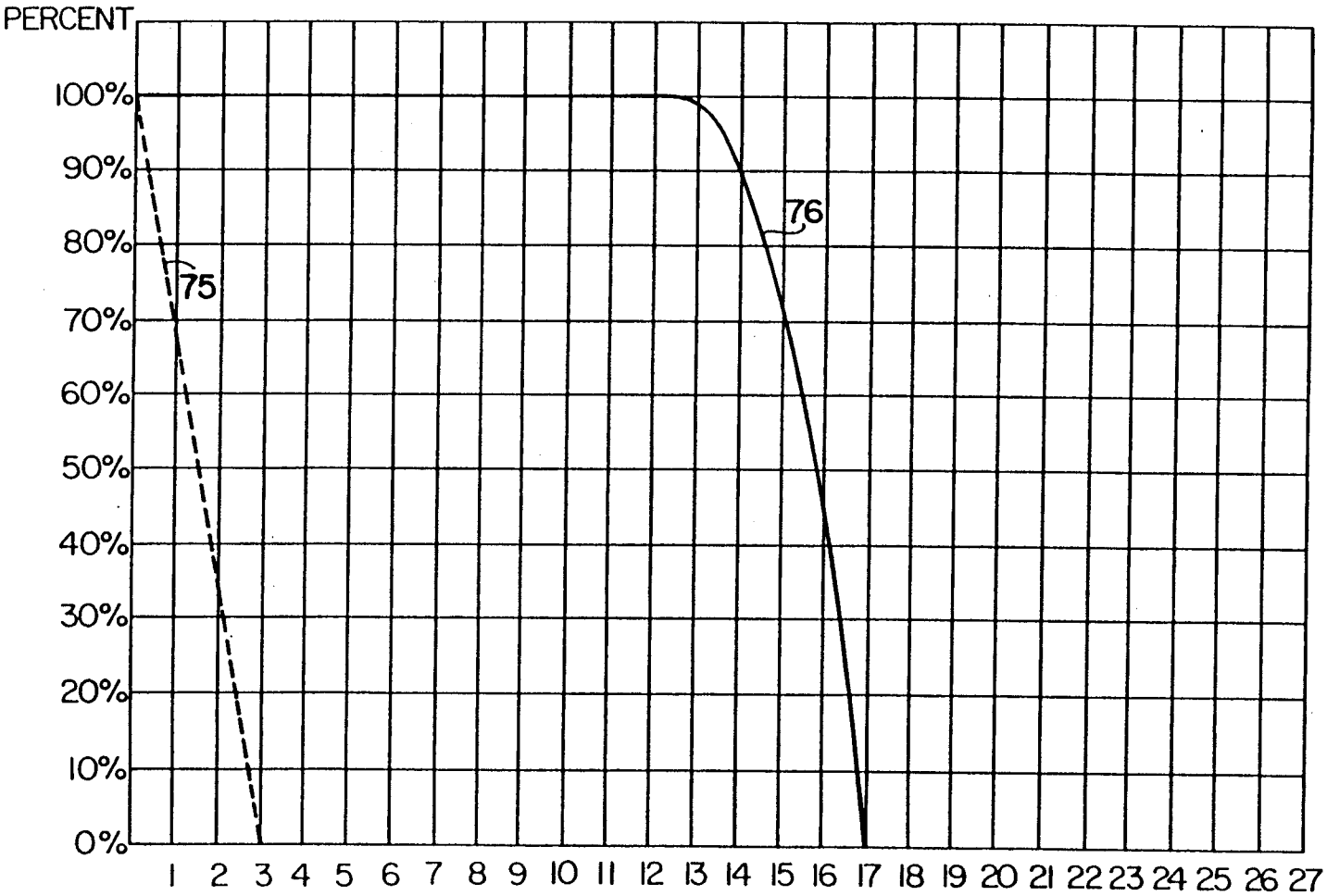
FIG. 6 is a diagrammatic view illustrating the relative lifetimes of the ribbon cartridge of FIG. 1 as compared with prior art ribbon cartridges.

As illustrated in FIG. 6, a ribbon cartridge system provided by the present invention allows for a substantial increase in both the quality of the printed characters as well as the number of characters that can be printed. With a ribbon cartridge system provided by the present invention, the number of characters which can be printed with the ribbon cartridge system is limited solely by the amount of ink contained in the reservoir. The ribbon cartridge system of FIG. 1 will print at least five times the number of characters as would a conventional roller based ribbon cartridge.

Moreover, the darkness of the printed characters remains essentially constant throughout the life of the present ribbon cartridge. Curve 75 indicates character darkness as a function of the number of times for known ribbon cartridges. These known ribbon cartridges provide an essentially linear degradation of character darkness beginning from almost the first character. In contrast, a ribbon cartridge provide according to the present invention provides us characters of essentially constant print darkness over almost the entire life of the ribbon cartridge (curve 76). This dramatic increase in performance is because of the several reasons cited above, in sum:

(1) Essentially indefinite shelf life because the ink reservoir is sealed until the ribbon cartridge is ready for use;

(2) Continuous self-inking provided by the wick system; and (3) Self-inking which occurs only when the printer is in use, eliminating localized saturation of the wick and the resultant dark or runny print.

Figure 7:
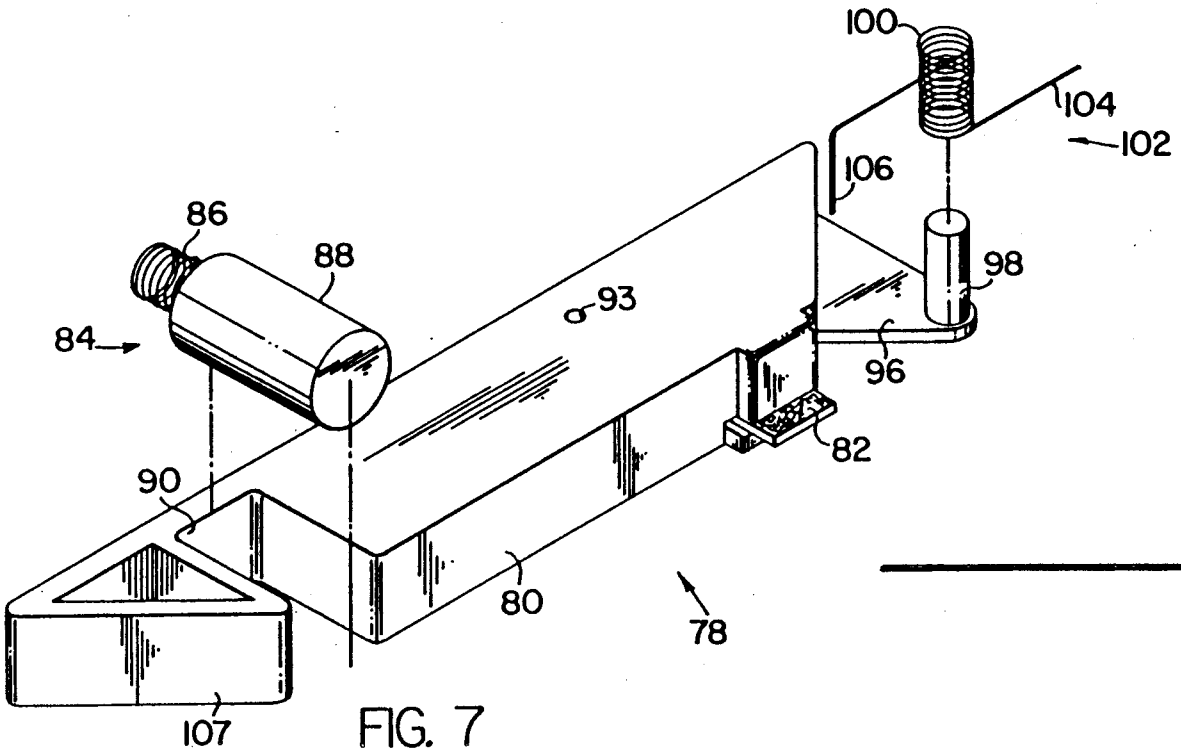
FIG. 7 is an exploded perspective illustration of an insert having a ribbon cartridge system provided according to the present invention.

Referring now to FIG. 7, there is shown an exploded perspective illustration of an insert ribbon cartridge system 78 provided according to the present invention. The insert system includes the components found in the ribbon cartridge system of FIG. 1 but are configured as a replaceable insert adapted to be received by a conventional shell or casing, detailed hereinafter with respect to FIG. 8.

The insert system 78 is characterized by a one piece housing 80 that is typically molded to have an exterior shape that conforms to an interior surface of a particular shell or casing. A ribbon tensioning mechanisms 84 comprising a spring 86 and cylinder 88 is received by a recess 90 formed in the plastic housing. The system 78 includes an internal ink reservoir of the type described hereinabove with respect to FIG. 4 providing ink through a wick 82. An opening 93 receives a pin (not shown) to puncture an internal seal allowing ink to flow from an upper ink reservoir cavity to a lower ink reservoir cavity thereby saturating the wick with ink.

The insert is also characterized by an extension 96 which spaces a post 98 from the main body of the housing 80 and is configured to receive a spring 100 that comprises a ribbon positioning mechanism 102. As shown in FIG. 7, the coaxial spring has a first end 104 which contacts a portion of the casing detailed with respect to FIG. 8 and a second portion 106 which extends outward from the post to receive and position the ribbon as described hereinabove. Alternatively, the one end 104 of the spring which contacts the casing interior surface can be located by a portion of the extension 96. The insert also comprises an end section 107 which is adapted to the particular interior configuration of the conventional casing or shell and may aid in guiding the ribbon to the ribbon tensioning mechanism.

Figure 8:
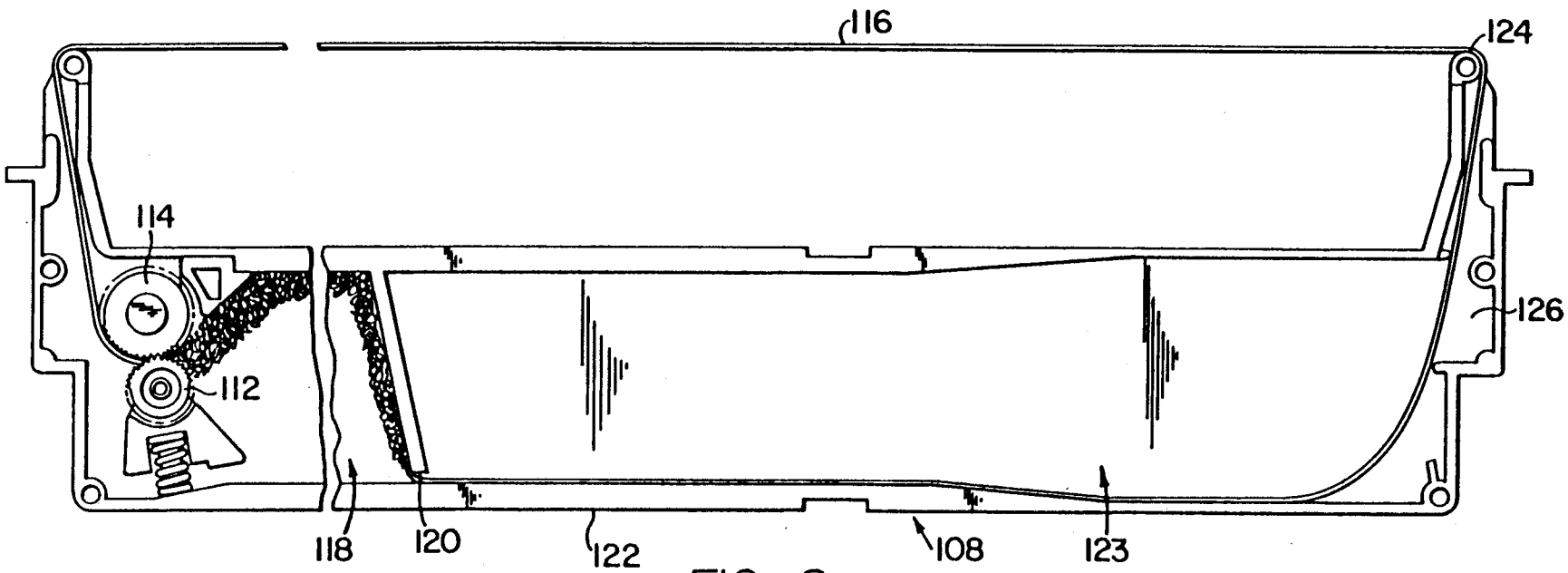
FIG. 8 is a top view of a conventional ribbon cartridge shell or casing adapted to receive the insert of FIG. 7.

Referring now to FIG. 8 there is shown a top illustration of a portion of a casing or shell 108. The casing 108 is conventional, and is adapted to be received by a particular printing device. Therefore, such conventional components as rollers 112 and 114 for advancing ribbon 116 are included. The operation of the cartridge is described hereinabove. Ribbon 116 is endless, and is stored in a first casing cavity 118. Only a portion of the ribbon and first cavity are shown for purposes of clarity. Typically, the ribbon is positioned randomly in the first cavity for storage and subsequently exits the first cavity at opening 120. The first cavity is bounded by an interior wall 122. The casing or shell is characterized by a second cavity 123 which may or may not contain additional wall portions (not shown) which are used to locate the ribbon as it traverse the second cavity and is received by roller 124. The insert 78 is received in this second cavity portion end, as noted, has an exterior geometry adapted to be received by a shell or casing second cavity. In some applications, this may require modification to the interior wall portions but typically the insert housing can be easily formed to accommodate the interior geometry of the second cavity such that the insert can be directly affixed to casing bottom surface 126 without modification. The magnitude of the forces exerted by the springs associated with the ribbon tensioning and ribbon positioning mechanisms 84 and 102, respectively, are cooperatively determined in a manner described hereinabove to ensure that the ribbon will be positioned against the wick only when the printing device is in operation (i.e. when the ribbon is being advanced) and spaced from the wick when the printing device is idle.

The installation of the insert of 78 is simple and direct. Since the insert can be readily configured to the interior geometries of existing ribbon cartridges, an insert can be configured for each given ribbon cartridge configuration. As a result, the need for replacing whole ribbon cartridges is eliminated.

Similarly, although the invention has been described hereinabove with respect to a preferred embodiment thereof, it should be understood by those skilled in the art that various changes, omissions and additions thereto may be made therein without departing from the spirit and scope of the invention.

We claim:

1. A ribbon cartridge system for use with a printing device, comprising:

an endless ribbon;

a case receiving said ribbon, said case adapted to be received by the printing device so that the ribbon will be advanced through the ribbon cartridge while the printing device is operational;

a plurality of roller means positioned within said case for guiding the ribbon during ribbon advancement;

an ink reservoir element including a container having liquid ink initially sealed in a first chamber, and including a means for selectively enabling said ink to flow to a second chamber and a wick configured with said second chamber to controllably present said ink at the exterior of said container; and a ribbon control means configured within said case to allow said ribbon to contact directly with said wick only when said ribbon is being advanced and to hold the ribbon out of engagement with said wick when said ribbon is not being advanced by the printing device.

2. The ribbon cartridge system of claim 1 wherein said second chamber includes ink flow control means for controlling fluid flow to said chamber to control the rate of delivery of said ink to said wick.

3. The ribbon cartridge system of claim 2 further comprising a first channel formed in the bottom surface of said second chamber, said first channel communicating with said wick and said ink flow control means.

4. The ribbon cartridge system of claim 3 further comprising a second channel configured to communicate with a portion of said wick exterior to said container, said second channel for communicating with said ink flow control means and for receiving excess ink from said wick and providing said excess ink back to said second chamber.

5. A one piece ribbon cartridge insert system for use with a ribbon cartridge case adapted to be received by a printing device, said case having an endless printing ribbon with a portion thereof stored in a first interior case cavity with said ribbon drawn through a second interior case cavity by means of a plurality of rollers in response to command signals from said printing device, said insert system comprising:

a housing means adapted to be received by said case second cavity;

an ink reservoir means positioned within said housing means including a container having liquid ink initially sealed in a first chamber, and further including a means for selectively enabling said ink to flow to a second chamber and a wick configured with said second chamber to controllably present said ink at the exterior of the insert; and a ribbon control means receiving said printing ribbon for selectively allowing said printing ribbon to contact directly with said wick only when said ribbon is being advanced and to hold the ribbon out of contacting engagement with said wick when said ribbon is not being advanced by the printing device.

6. The ribbon cartridge insert system of claim 5 wherein said second chamber includes ink flow control means controlling fluid flow to said second chamber to control the rate of delivery of said ink to said wick.

7. The ribbon cartridge insert system of claim 6 further comprising a first channel formed in the bottom surface of said second chamber, said first channel communicating with said wick and said ink flow control means.

8. The ribbon cartridge insert system of claim 7 further comprising a second channel configured to communicate with a portion of said wick exterior to said container, said second channel for communicating with said ink flow control means and for receiving excess ink from said wick and providing said excess ink back to said second chamber.

9. A reservoir element for supplying a ribbon cartridge with liquid ink, the ribbon cartridge having a case and an endless ribbon circulating therein, said element comprising:

a container having first and second chambers, the liquid ink initially being sealed in said first chamber;

ink flow enablement means for selectively enabling the ink to flow from said first chamber to said second chamber;

airflow means for providing air to said first chamber when said ink flows to said second chamber;

a wick configured with said second chamber to controllably present the ink at the exterior of said container;

ink flow control means communicating with said wick and said second chamber for providing supplemental control of fluid flow in said chambers to control the rate of delivery of said ink to said wick;

said container being configured such that, when the reservoir element is in the ribbon cartridge and the ribbon cartridge is in operation, said first chamber is above said second chamber;

said second chamber further comprises a first and a second channel communicating with a portion of said wick, and wherein said ink flow control means comprises a channel communicating with both said wick and said first and second channels;

a substantially planar seal member separating said first and second chambers from one another and having a weakened portion in communication with one of said first and said second channels formed in said second chamber.

10. The element of claim 9 wherein said wick further comprises a second wick configured therewith for providing excess ink back to said container second chamber.

11. The element of claim 9 wherein said wick comprises a spun-bonded polyester fibrous material.

12. The reservoir element of claim 9 wherein said airflow means is adapted to receive said ink flow enablement means.

13. A ribbon cartridge system for use with a printing device, comprising:

an endless ribbon;

a case receiving said ribbon, said case adapted to be received by the printing device so that the ribbon will be advanced through the ribbon cartridge while the printing device is operational;

a plurality of roller means positioned within said case for guiding the ribbon during ribbon advancement;

an ink reservoir element including a container having liquid ink initially sealed in a first chamber, and including a means for selectively enabling said ink to flow to a second chamber and a wick configured with said second chamber to controllably present said ink at the exterior of said container; and a ribbon control means configured within said case to allow said ribbon to communicate with said wick only when said ribbon is advanced by the printing device;

said ribbon control means comprising ribbon tensioning means for providing tension to a portion of said ribbon drawn past said wick, and comprising a ribbon positioning means for applying a force to laterally displace said ribbon from said wick.

14. The ribbon cartridge system of claim 13 wherein said ribbon positioning means applied force has a magnitude less than or equal to a difference in force magnitude applied by said ribbon tensioning means and said roller means when said ribbon is advanced.

15. A one piece ribbon cartridge insert system for use with a ribbon cartridge case adapted to be received by a printing device, said case having an endless printing ribbon with a portion thereof stored in a first interior case cavity with said ribbon drawn through a second interior case cavity by means of a plurality of rollers in response to command signals from said printing device, said insert system comprising:

a housing means adapted to be received by said case second cavity;

an ink reservoir means positioned within said housing means including a container having liquid ink initially sealed in a first chamber, and further including a means for selectively enabling said ink to flow to a second chamber and a wick configured with said second chamber to controllably present said ink at the exterior of the insert;

a ribbon control means receiving said printing ribbon for selectively communicating said printing ribbon with said wick only when said ribbon is advanced by the printing device;

said ribbon control means comprising ribbon tensioning means for providing tension to a portion of said ribbon drawn past said wick, and comprising ribbon positioning means for applying a force to laterally displace said ribbon from said wick.

16. The ribbon cartridge insert system of claim 15 wherein said ribbon positioning means applied force has a magnitude less than or equal to a difference in force magnitude applied by a ribbon tensioning means and said roller means when said ribbon is advanced.

* * * * *